US009601099B2

(12) United States Patent
Steele

(10) Patent No.: US 9,601,099 B2
(45) Date of Patent: Mar. 21, 2017

(54) ELECTRONIC BASS DRUM

(71) Applicant: Mark David Steele, New Smyrna Beach, FL (US)

(72) Inventor: Mark David Steele, New Smyrna Beach, FL (US)

( * ) Notice: Subject to any disclaimer, the term of this patent is extended or adjusted under 35 U.S.C. 154(b) by 86 days.

(21) Appl. No.: 14/319,492

(22) Filed: Jun. 30, 2014

(65) Prior Publication Data

US 2015/0379977 A1 Dec. 31, 2015
US 2016/0217777 A9 Jul. 28, 2016

Related U.S. Application Data

(60) Provisional application No. 61/957,593, filed on Jul. 8, 2013.

(51) Int. Cl.

| | |
|---|---|
| ***G10H 3/00*** | (2006.01) |
| ***G10H 3/18*** | (2006.01) |
| ***G10H 3/14*** | (2006.01) |
| ***G10H 1/32*** | (2006.01) |
| ***G10H 1/34*** | (2006.01) |
| ***G10D 13/02*** | (2006.01) |

(52) U.S. Cl.
CPC ..... *G10H 3/146* (2013.01); *G10D 13/024* (2013.01); *G10H 1/32* (2013.01); *G10H 1/348* (2013.01); *G10H 3/18* (2013.01)

(58) Field of Classification Search
CPC ..... G10H 3/18; G10H 3/146; G10H 1/348
USPC ..... 84/723, 746, 743
See application file for complete search history.

(56) References Cited

U.S. PATENT DOCUMENTS

| | | | | |
|---|---|---|---|---|
| 3,553,339 | A * | 1/1971 | Dominguez | G10H 3/146 84/725 |
| 3,638,753 | A * | 2/1972 | Cunningham | H04R 1/345 181/153 |
| 4,242,937 | A * | 1/1981 | Pozar | G10D 13/02 84/411 R |
| 4,732,070 | A * | 3/1988 | Yamashita | G10H 3/146 248/188.5 |
| 4,819,536 | A * | 4/1989 | Lombardi | G10D 13/006 84/422.1 |
| 4,947,725 | A * | 8/1990 | Nomura | G10D 13/024 84/723 |
| 5,293,000 | A | 3/1994 | Adinolfi | |
| 5,361,669 | A | 11/1994 | Genna | |
| 5,811,709 | A | 9/1998 | Adinolfi | |
| 6,075,197 | A | 6/2000 | Chan | |
| 6,121,528 | A * | 9/2000 | May | G10D 13/02 84/411 R |
| 6,201,173 | B1 * | 3/2001 | Black | G10D 13/006 84/104 |

(Continued)

*Primary Examiner* — David Warren
*Assistant Examiner* — Christina Schreiber
(74) *Attorney, Agent, or Firm* — William C. Schrot; AuerbachSchrot LLC

(57) ABSTRACT

An Electronic Bass Drum includes one or more loudspeakers, an internal amplifier system, a removable electronic drum module and control panel, at least one impact sensitive electronic kick pad, an attachment for mounting a bass drum pedal, mounting hardware for tom toms or other acoustic or electronic instruments, legs for stabilization, one or more headphone jacks for silent play, input jacks for other instruments and/or microphones, and an MP3 player cradle for playing along with or recording music.

31 Claims, 15 Drawing Sheets

(56) References Cited

U.S. PATENT DOCUMENTS 6,218,602 B1 * 4/2001 Davis ..... G09B 15/023 84/477 R
6,956,956 B2 * 10/2005 Kuratani ..... H04R 1/02 381/345
6,982,376 B2 * 1/2006 Wise ..... G10H 3/146 84/104
7,030,305 B1 * 4/2006 Cupid ..... G10H 3/12 84/402
7,179,985 B2 * 2/2007 Pickens ..... G10H 3/12 84/411 R
7,282,633 B1 * 10/2007 Coolidge ..... G10H 3/143 84/104
7,525,039 B2 * 4/2009 Steele ..... G10H 3/146 84/743
7,964,781 B1 * 6/2011 Lovvorn ..... G10D 13/06 84/327
8,170,259 B2 * 5/2012 Liu ..... H04R 1/02 381/365
8,354,581 B2 * 1/2013 Eventoff ..... G10D 13/024 84/104
D681,105 S * 4/2013 Steele ..... D17/22
8,481,832 B2 * 7/2013 Lloyd ..... G06F 1/1632 361/679.41
8,916,761 B2 * 12/2014 Robertson ..... G10H 3/186 84/600
8,957,297 B2 * 2/2015 Urry ..... G10H 1/06 84/721
9,117,431 B1 * 8/2015 Rudes ..... G10H 1/32
9,124,967 B2 * 9/2015 Morton ..... G10H 3/146
2002/0062726 A1 * 5/2002 Abe ..... G10H 1/0016 84/464 A
2003/0188629 A1 * 10/2003 Suenaga ..... G10H 3/146 84/723
2004/0211310 A1 * 10/2004 Hagiwara ..... G10H 3/146 84/726
2005/0022655 A1 * 2/2005 Wise ..... G10H 3/146 84/743
2005/0126378 A1 * 6/2005 Ludwig ..... G10H 1/32 84/746
2006/0021495 A1 * 2/2006 Freitas ..... G10H 3/12 84/723
2006/0064186 A1 * 3/2006 Ryle ..... G10H 3/186 700/94
2007/0221040 A1 * 9/2007 Bailey ..... G10D 13/00 84/411 R
2007/0234880 A1 * 10/2007 Adams ..... G10H 1/0066 84/601
2009/0007763 A1 * 1/2009 Steele ..... G10H 3/146 84/746
2010/0180750 A1 * 7/2010 Steele ..... G10H 1/32 84/422.3
2010/0242713 A1 * 9/2010 Prado Lopez ..... G10D 13/021 84/723
2010/0261513 A1 * 10/2010 Izen ..... G10H 3/146 463/7
2011/0056361 A1 * 3/2011 Steele ..... G10H 1/348 84/422.3
2011/0116634 A1 * 5/2011 Norman ..... H04L 9/3247 380/277
2011/0299238 A1 * 12/2011 Radin ..... G06F 3/165 361/679.41
2012/0006178 A1 * 1/2012 Steele ..... G10D 13/006 84/421
2012/0204704 A1 * 8/2012 Shim ..... G10H 1/0066 84/645
2013/0152768 A1 * 6/2013 Rapp ..... G10H 3/125 84/634

* cited by examiner

ELECTRONIC BASS DRUM

CROSS REFERENCE TO RELATED APPLICATION AND CLAIM TO PRIORITY

This application is based on U.S. Provisional Application Ser. No. 61/957,593, filed Jul. 8, 2013, the disclosure of which is incorporated herein by reference and to which priority is claimed.

BACKGROUND OF THE INVENTION

This invention relates generally to the field of musical instruments and more specifically to a complete system for an electronic bass drum.

Virtually every drum kit has a bass drum, whether it is an acoustic set or an electronic set. This invention is designed to replace current bass drums in every type of drum set.

In FIG. 1, a current technology acoustic drum set is presented, including a conventional acoustic bass drum. Note that there is the bass drum itself 21, a special bass drum microphone 22 and individual drum microphones 22*a* for picking up sounds when more volume is required, an amplifier/mixer or P.A. device 23 and speakers 24 to play the sounds to the audience. Also note that the pitch and voice quality of the bass drum always remains the same, and that the whole setup includes several components that are usually spread out and inaccessible to the drummer, most notably the volume control. And that each component usually has its own heavy wooden case that adds to the weight and setup complexity of the system.

FIG. 1*a* shows the same drum kit, except for the acoustic bass drum which has been replaced by my invention 25. Note that all of the peripheral amplification and sound equipment has also been replaced, by my single instrument. And because the invention includes an electronic drum module, the performer is able to control the voice quality of the bass drum at will, and all volume adjustment controls are readily available.

Current technology electronic drum sets FIG. 2, usually include a pedal 26, an impact sensitive electronic kick pad 27, a drum module 28 and an amplification system or P.A. 29 for performing. There are advantages to using an electronic drum set. The tonal quality of the drums is instantly variable; most modern drum modules offer over 500 different sounds, and these sounds are readily changeable depending upon the style of music played. Also, there is usually a volume control that is easily within reach of the drummer. But there are still drawbacks to existing technology. An external amplification or P.A. system 29 still needs to be set up.

In FIG. 2*a*, the electronic bass drum 25 replaces the current kick pad, module, and amplification systems with a single, easily transportable instrument. Not only is my electronic bass drum used for an entire electronic drum set; an entire band can use the drum to play their music live or have a silent band practice.

Cosmetically, a large bass drum shape is very much desired by all drummers, and current electronic bass drum technology is shunned by most conventional acoustic drummers for this reason. And there is no system for mounting tom-toms or other percussion instruments on the typical electronic bass drum. My invention overcomes all of the limitations listed above.

The invention described herein is similar to the instrument that is described in my previous U.S. Pat. No. 7,525,039, with some additional features. Most notably, there is a system for mounting and protecting commercially available drum modules, using a shock-proof mount which I have designed. This system makes it simpler for amplifier companies to manufacture the instrument, and it allows drummers to use their existing drum modules rather than purchase one that is incorporated into the shell. Special jacks allow drum modules to be used wherever they are mounted; either on my bass drum or in a remote location.

BRIEF SUMMARY OF THE INVENTION

An object of the invention is to offer acoustic drummers a bass drum with dozens of different sounds.

A further object is to have several acoustic drum microphone jacks readily available.

Another object is to provide an amplification and speaker system built into the shell of a single instrument, eliminating the need for separate components.

A further object is to have tom-tom and other mounting brackets incorporated into an electronic bass drum.

Another object is to have a mounting system for electronic pads that more closely resembles an acoustic set, eliminating bulky racks currently in use.

A further object is to allow drummers to attach and incorporate any type of drum module onto the instrument.

Another object is to allow drummers to use drum modules that are not attached to the instrument.

Yet another object is to protect mounted drum modules with a shock resistant mounting system.

Another object is to have sound level and drum tone changes readily available to the performer.

Yet another object is to have multiple input jacks for the drum module readily available.

Another object is to allow other band members the capability of sharing the built-in amplification and speaker systems, conceivably performing solely through this one device.

Yet another object is to incorporate a headphone system for a completely quiet band practice.

A further object is to allow for the use of an MP3 player device for play-along practice and recording.

Other objectives and advantages of the present invention will become apparent from the following descriptions, taken in connection with the accompanying drawings, wherein, by way of illustration and example, an embodiment of the present invention is disclosed.

BRIEF DESCRIPTIONS OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. 1 shows a common acoustic drum configuration using current technology, as viewed from the front.

FIG. 1*a* shows the same drum set with components replaced by the invention.

FIG. 2 shows a common electronic drum set using current technology, as viewed from the rear.

FIG. 2*a* shows the same electronic drum set with components replaced by the invention.

FIG. 2*b* shows the invention in use with a remotely mounted drum module.

Figure 10A:
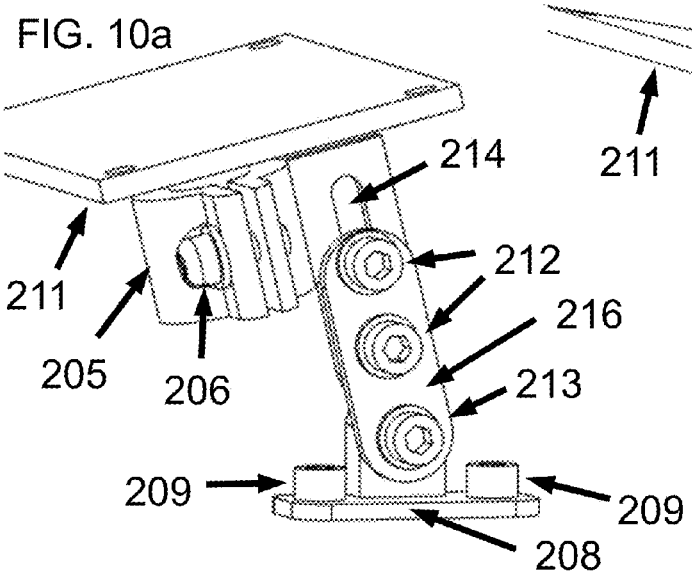
Figure 10B:
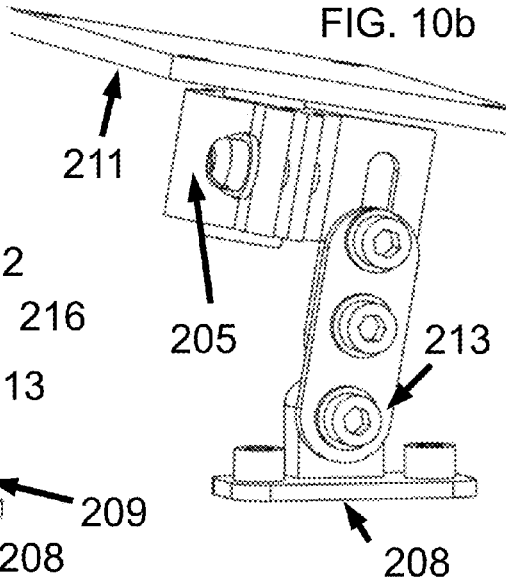

FIGS. 10*a* and 10*b* show a side view of a shock absorbing module mount.

Figure 10C:
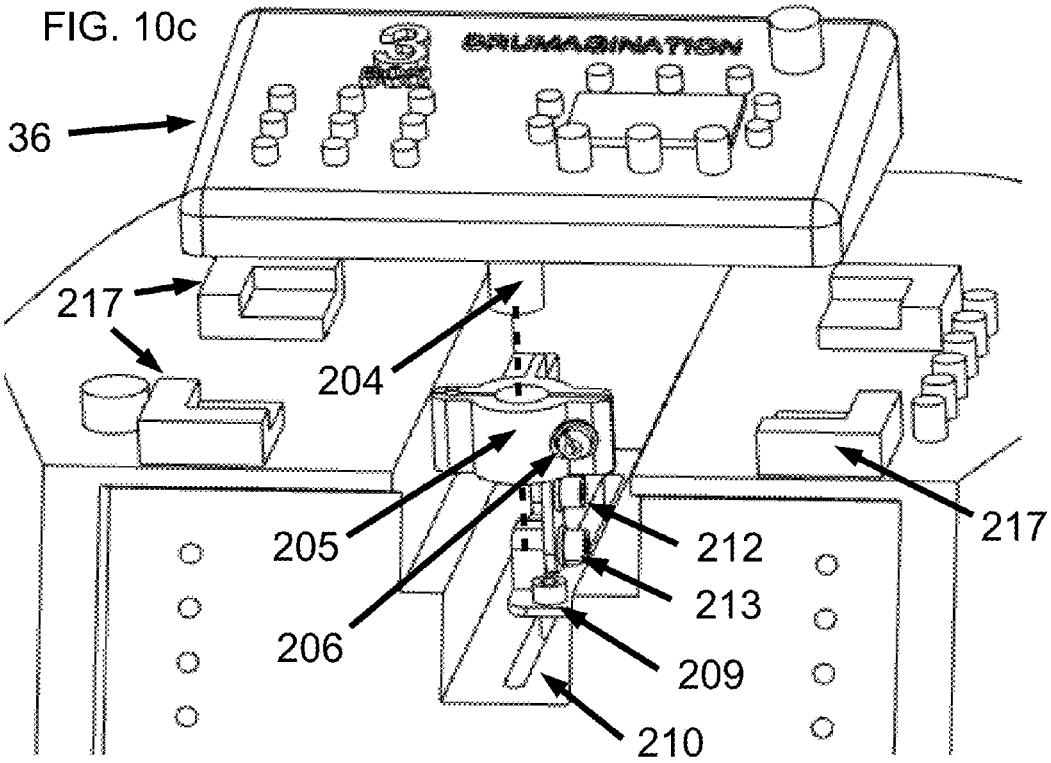

FIG. 10*c* is a rear view of a shock absorbing module mount.

Figure 11:
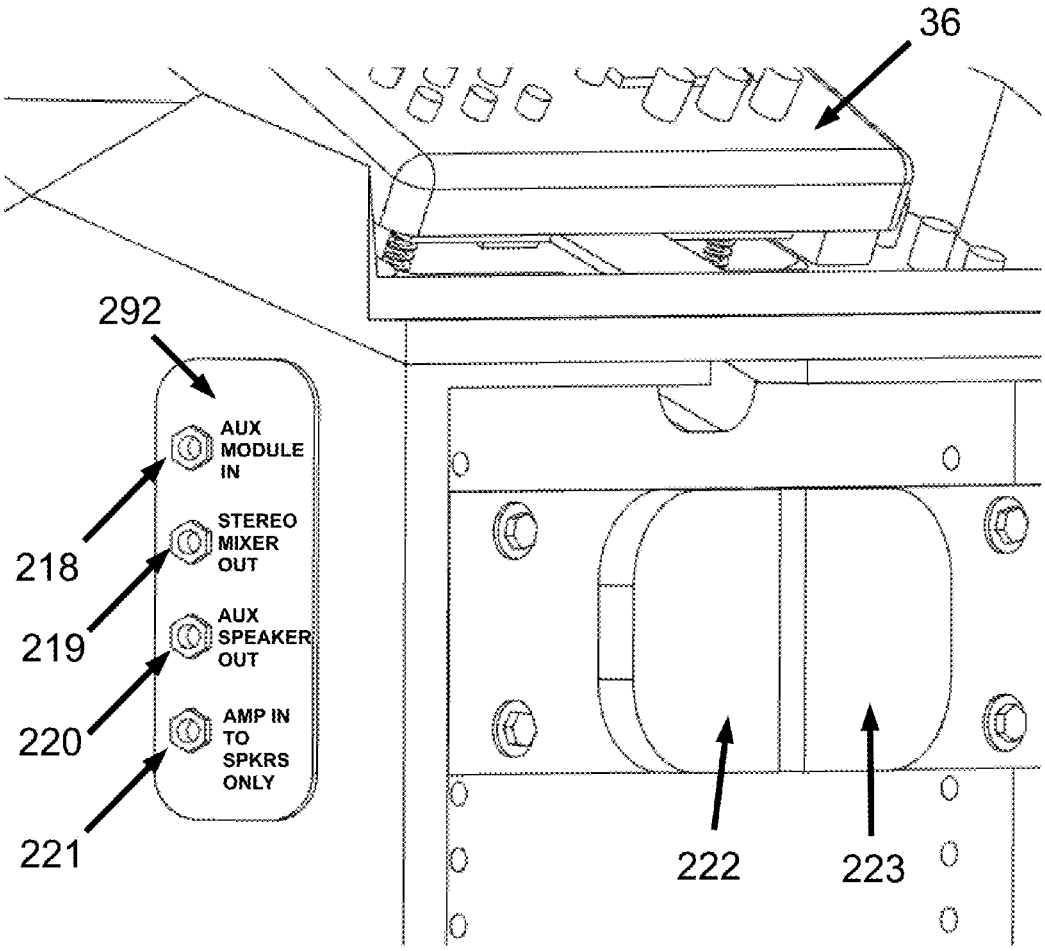

FIG. 11 is a left rear view of an auxiliary panel.

Figure 11A:
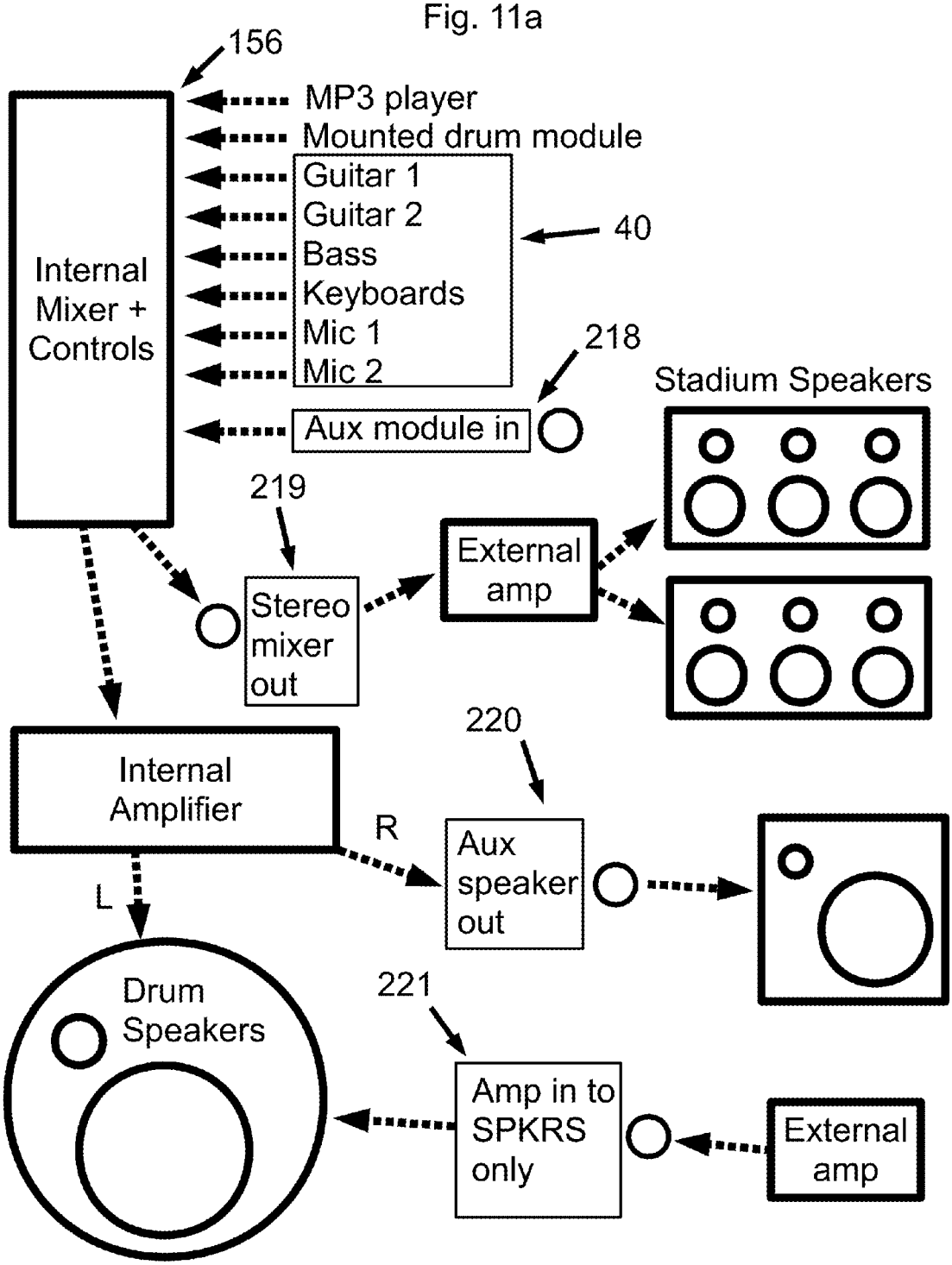

FIG. 11*a* is a schematic of internal electrical connections and auxiliary jacks.

Figure 12:
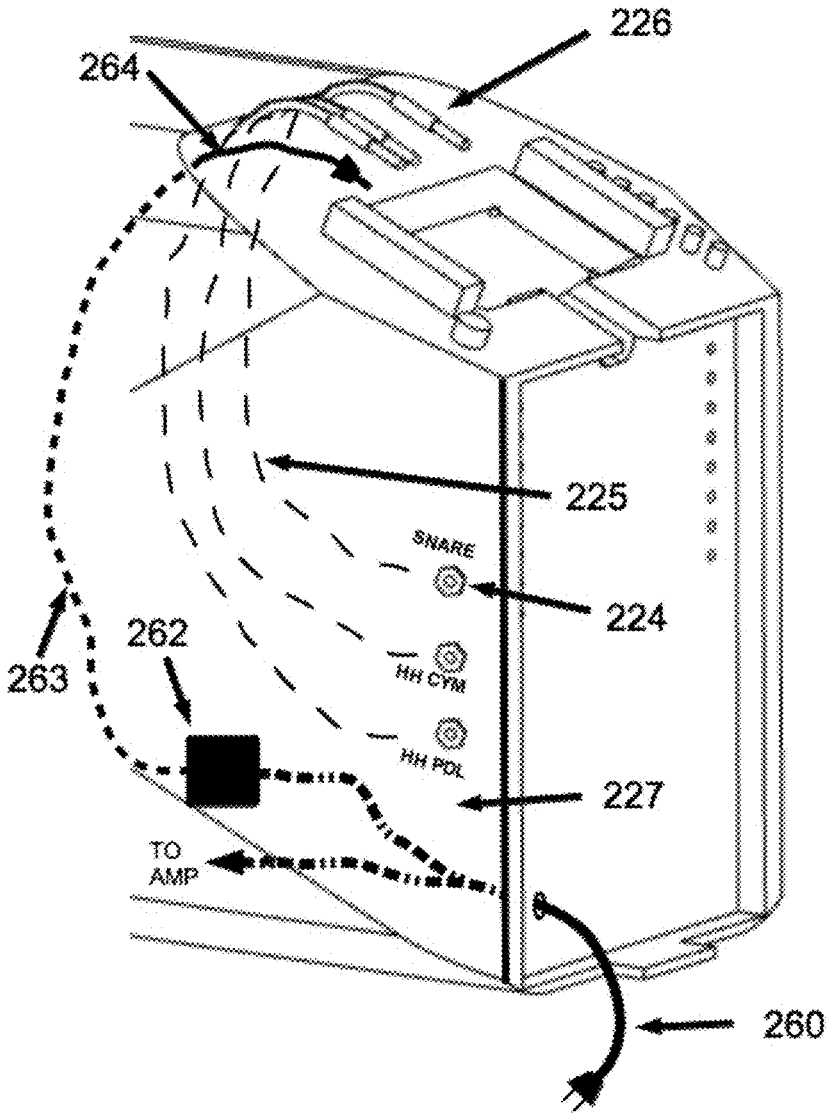

FIG. 12 is a left rear view of internal extension cables.

Figure 13:
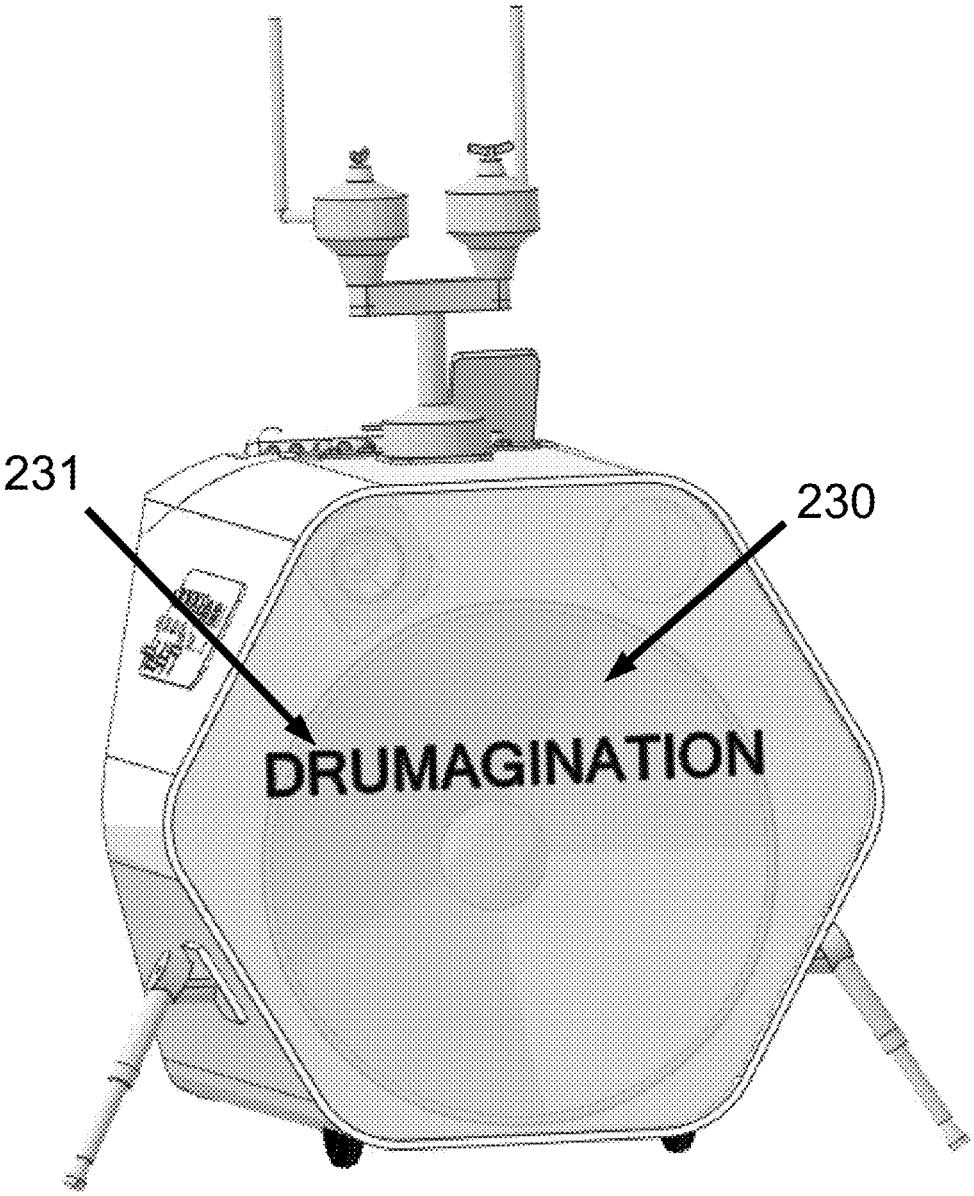

FIG. 13 is a front view of a speaker cover.

Figure 14A:
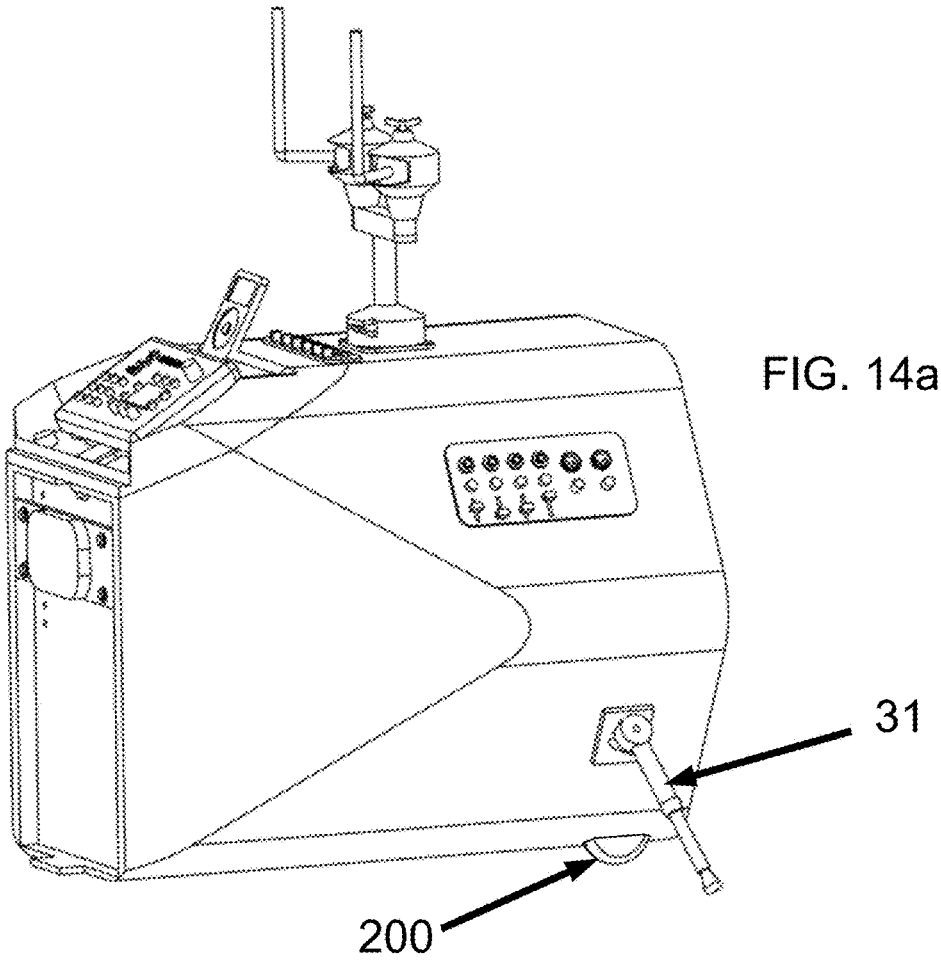

FIG. 14*a* is a side view of the instrument while it is being played.

Figure 14B:
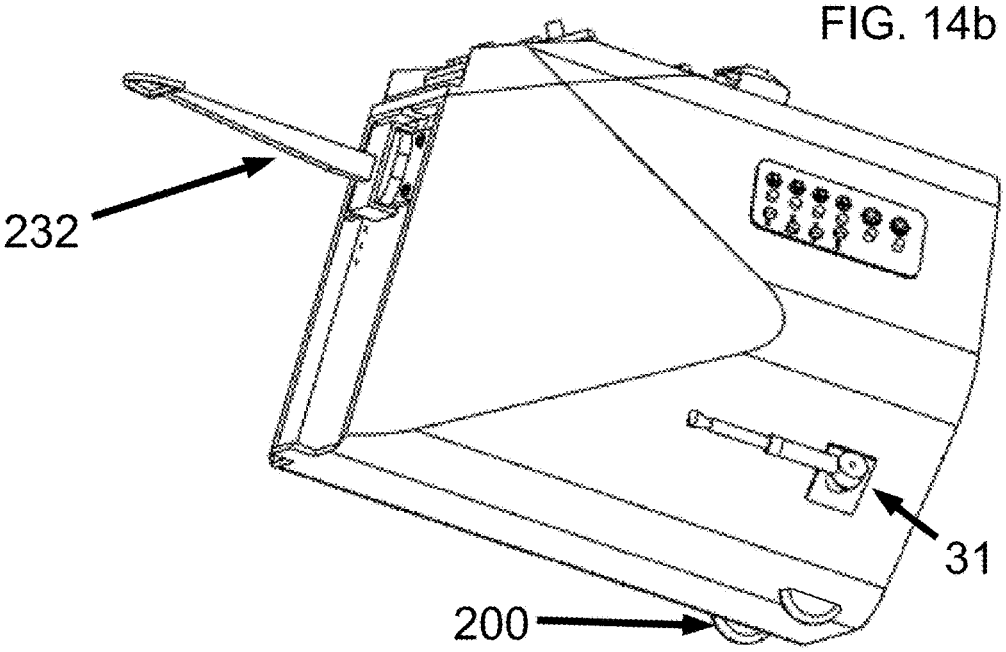

FIG. 14*b* is a side view of the instrument while it is being transported.

DETAILED DESCRIPTION OF THE INVENTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 3:
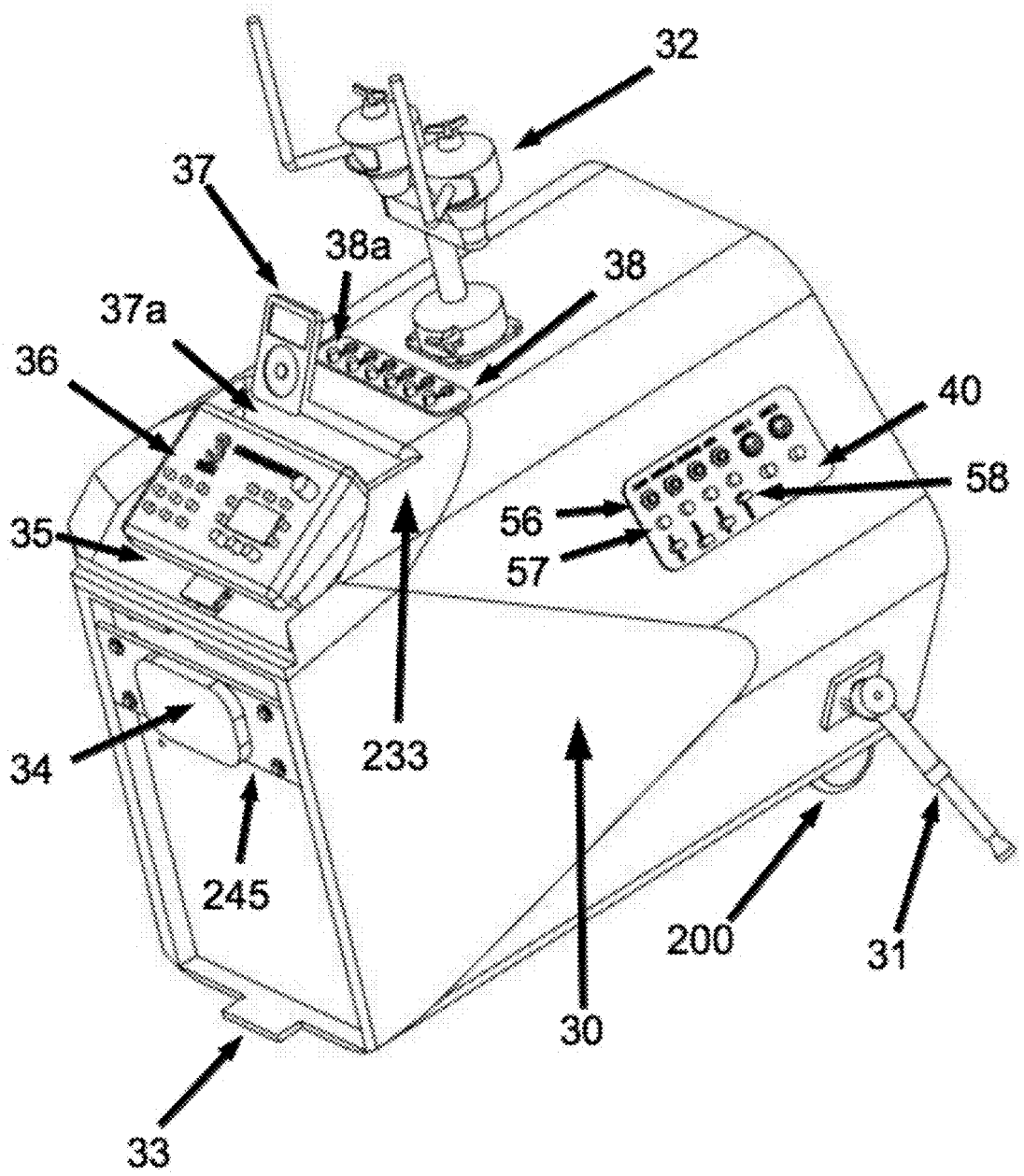
FIG. 3 is an overhead view from the right rear of the invention showing the primary features.

FIG. 3 gives an overview of most of the essential parts of an electronic bass drum in accordance with one embodiment of the invention, wherein the parts identical to those shown in FIGS. 3 though 11 are designated by the same reference numerals. An outer shell 30 is used, and the external finish of said outer shell would probably match the other drums in each individual kit. The outer shell 30 may or may not be cylindrical. Stabilization legs 31 and tom-tom mounts 32 are designed for prior art acoustic bass drums and are useable in the invention as well. All other mounting hardware designed for mounting additional percussion instruments designed for conventional acoustic bass drums will work on this electronic bass drum. There is an attachment bracket 33 for mounting a bass drum pedal at the rear of the invention, and an impact sensitive electronic drum kick pad 34 is installed for striking with said bass drum pedal. A flexible mounting bracket for an electronic kick drum pad 245 helps to dampen the vibration created when a drum pedal strikes the pad. The electronic kick pad signal is sent to the drum module 36 that is mounted to the shell and makes up part of the control panel 35. There is an MP3 player 37 and receptacle 37*a* that allows the drummer to practice along with music, or to record practice sessions. There are several optional input jacks 38 for acoustic drummers that want input jacks for their drum microphones. Microphone volume adjustment controls 38*a* are shown. The auxiliary input panel 40 of FIG. 3 has several input jacks 56 that allow other performers to play their instruments through the internal amplifier of the invention. Each input to the amplifier has an input volume control 57. Built-in wheels 200 allow for easy transport. And an optional removable cowling 233 helps to conceal the drum module.

Figure 4:
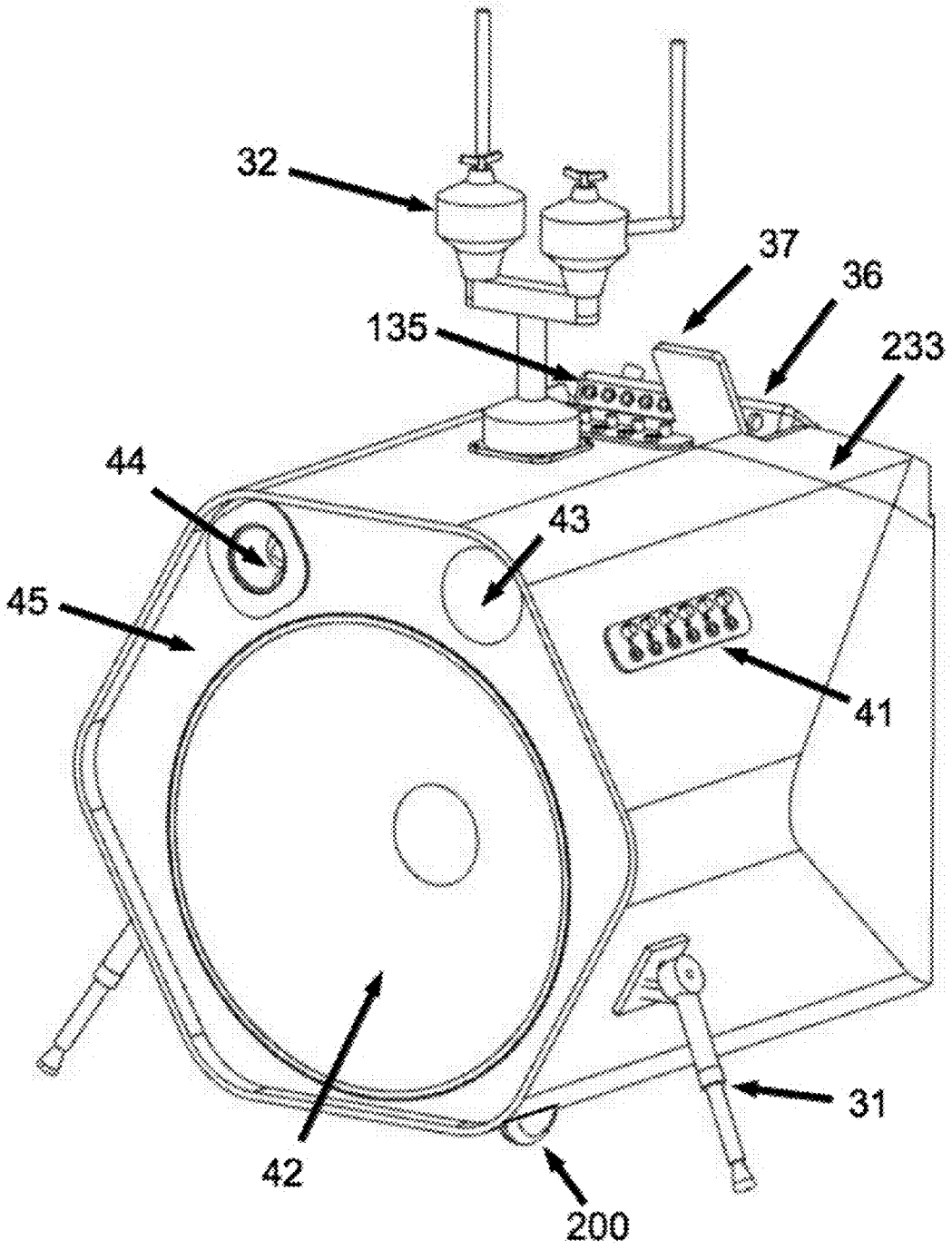
FIG. 4 is a front quarter view showing loudspeaker installation.

FIG. 4 shows the front end of the instrument, where one or more loudspeakers or drivers can be mounted in a variety of ways. In this embodiment, there is depicted a woofer 42, and a tweeter 44 all mounted to the forward wall 45. A vent 43 is shown for optimizing speaker performance. There is also an auxiliary headphone panel 41 that allows several band members to listen to the combined inputs to the internal amplifier, as well as the drum module 36 and MP3 player 37 as desired. Multiple electronic drum instruments can be plugged into the back of the drum module 36 using individual jacks 135 or a single multiple connector snake (not shown).

The electronic bass drum is designed so that an entire band can plug into the invention and practice together silently through headphones, or perform together through the integrated amplifier and speaker system. An optional cosmetic cowling 233 is shown.

Figure 5:
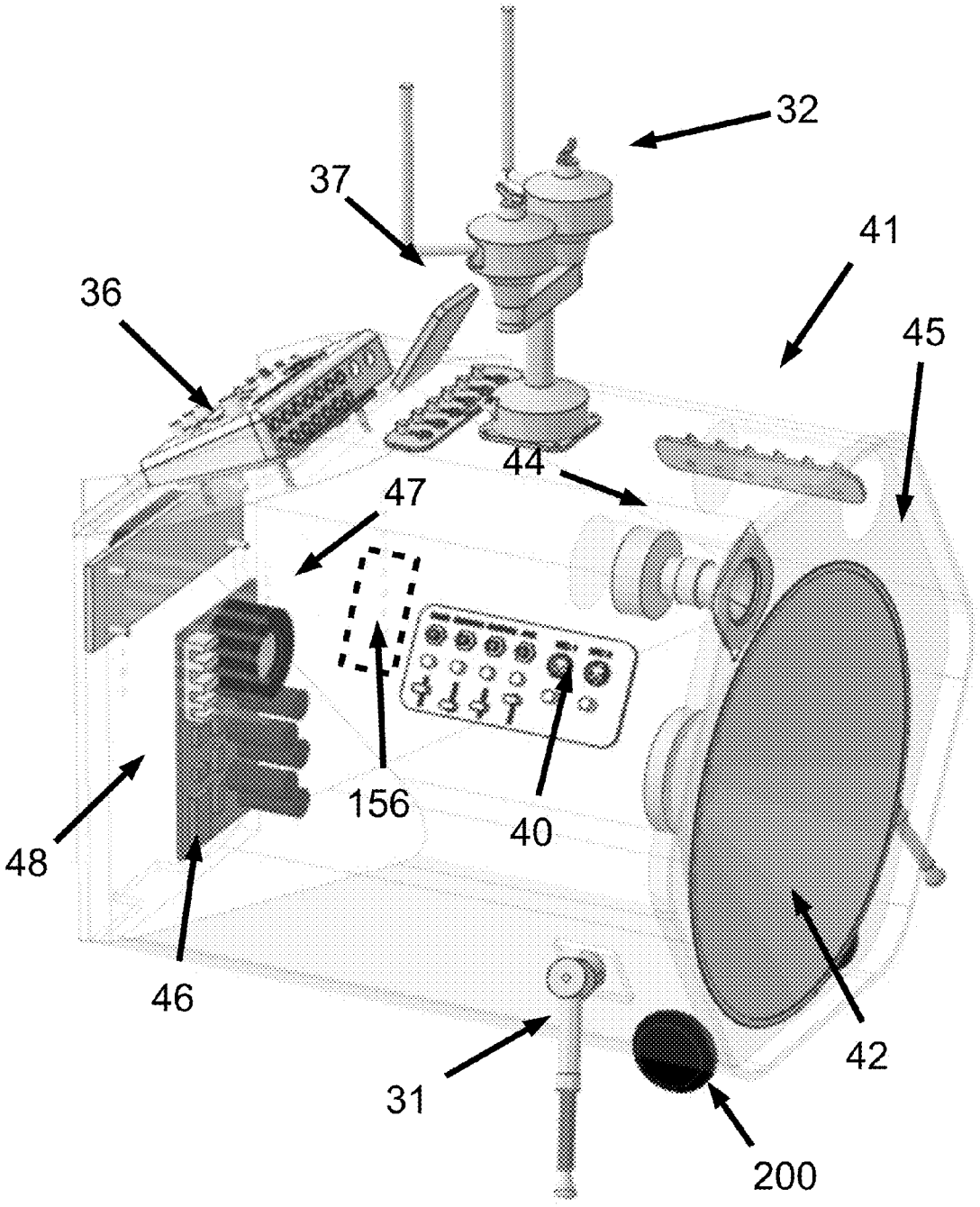
FIG. 5 is a cutaway view showing the internal components of the invention.

FIG. 5 is a cutaway view of the internal parts of the instrument, and shows how several previously separate components can be combined into a single instrument. The internal amplifier 46 is mounted to a rear wall 48. There is an optional internal cooling fan 47 that circulates air throughout the invention, in order to prevent the overheating of the internal electronics. There is more than adequate room for an array of speakers 42, 44 mounted on the forward wall 45. An input panel 40 allows several drummers to plug into and play through the invention, using an internal mixer 156.

Figure 6:
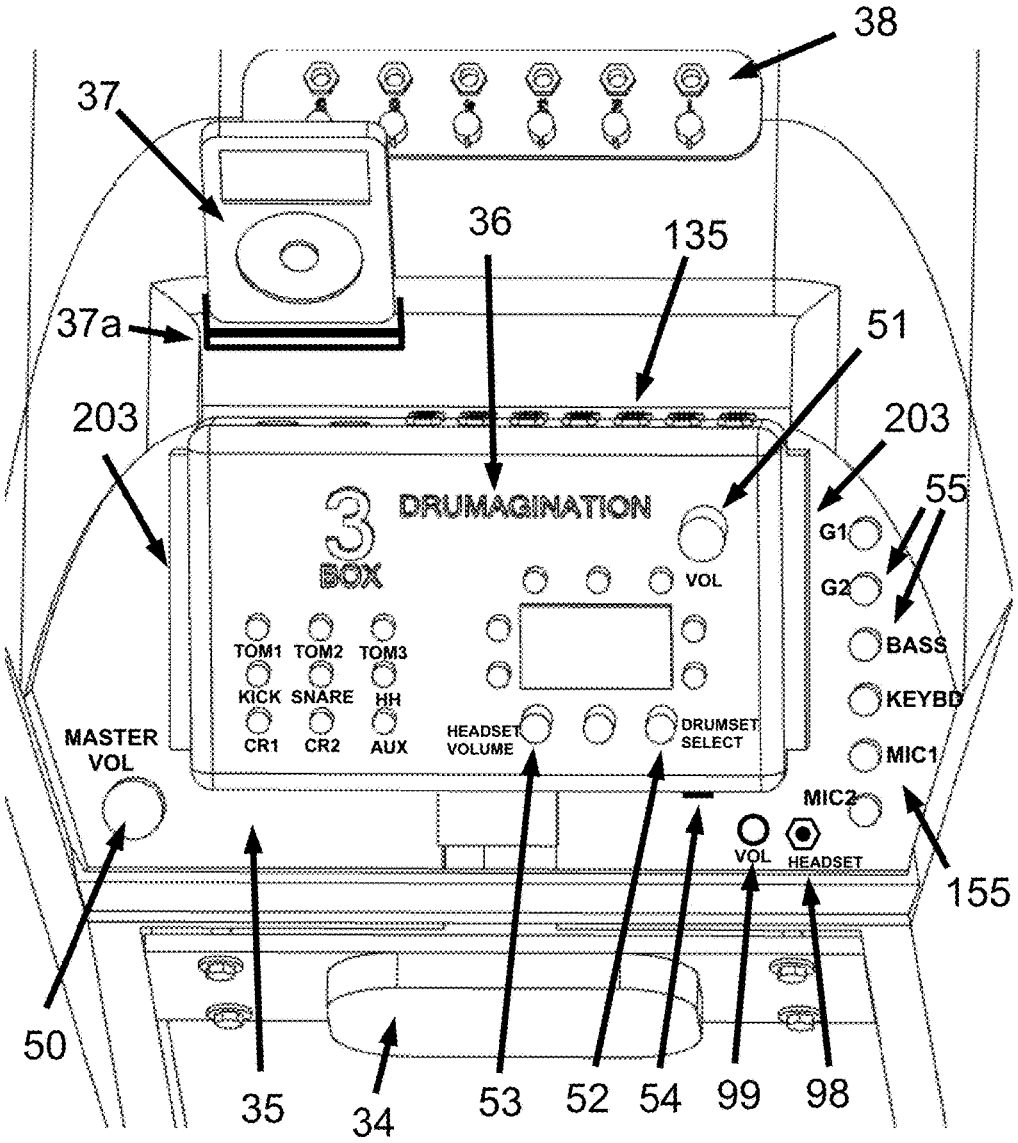
FIG. 6 shows the electronic controls and external components from the top rear of the invention.

FIG. 6 shows a close-up of the main control panel 35 for the internal amplifier and the drum module 36. Note that this is but one possible arrangement, and there are several ways to set up the controls. All critical control functions are easily within reach, starting with the master amplifier volume control knob 50. The drum set select knob 52 enables the performer to quickly change the tonal quality of the externally mounted kick pad 34 as well as all other electronic percussion instruments plugged into the drum module 36 using the module input jacks 135. The module output volume control knob 51 is used to vary the output level of the sounds sent from the drum module to the amplifier or internal mixer. If several musicians were plugged into the invention using the auxiliary input panel and the drum sound level was too high for the group, this control would be used to lessen the sound level of the drums only.

Since most drummers use recorded music to practice with, there is included an MP3 player dock 37*a* which holds a removable MP3 player 37. The output from the MP3 player can be heard through the drummer's headphone mixer jack 98. The drummer may choose to monitor the entire band using the headphone mixer jack 98 and the associated volume control 99, or just monitor the drum module using the module-only headphone jack 54 and volume control 53.

There is an internal mixer that is used to balance the sound levels of all the instruments connected to the invention, and the relative volume for all of the accompanying inputs can be controlled by the drummer using the external mixing controls 55 located on the internal mixer control panel 155. Note that all instrument volume levels can be changed quickly and easily, and in many cases levels will be adjusted during live play. The schematic is shown in FIG. 11*a*.

The module rests on shock-dampening foam pads 203. These items are part of a module shock mount system which will be described below.

Figure 7:
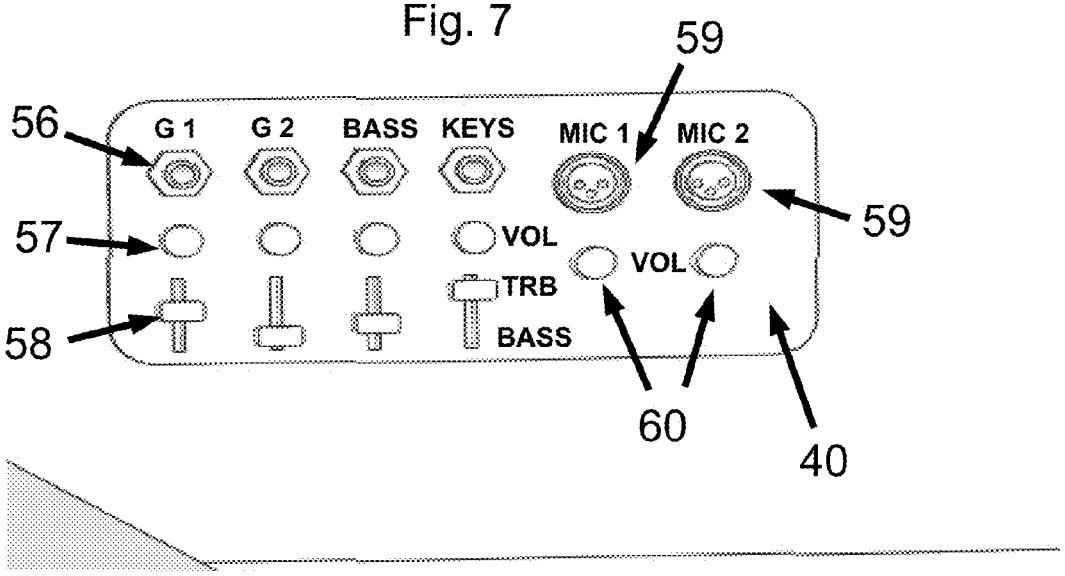
FIG. 7 shows the auxiliary instrument input panel on the right side of the instrument.

FIG. 7 shows the right side of the instrument where the external input jack panel 40 could be located. There is depicted a row of external input jacks 56 for other band members to plug in their electric instruments, and each input has a volume control 57 and an equalizer control 58. Two input jacks for microphones 59 are also shown, with their respective volume control knobs 60. The number of inputs may vary. The schematic is presented in FIG. 11*a*.

Figure 8:
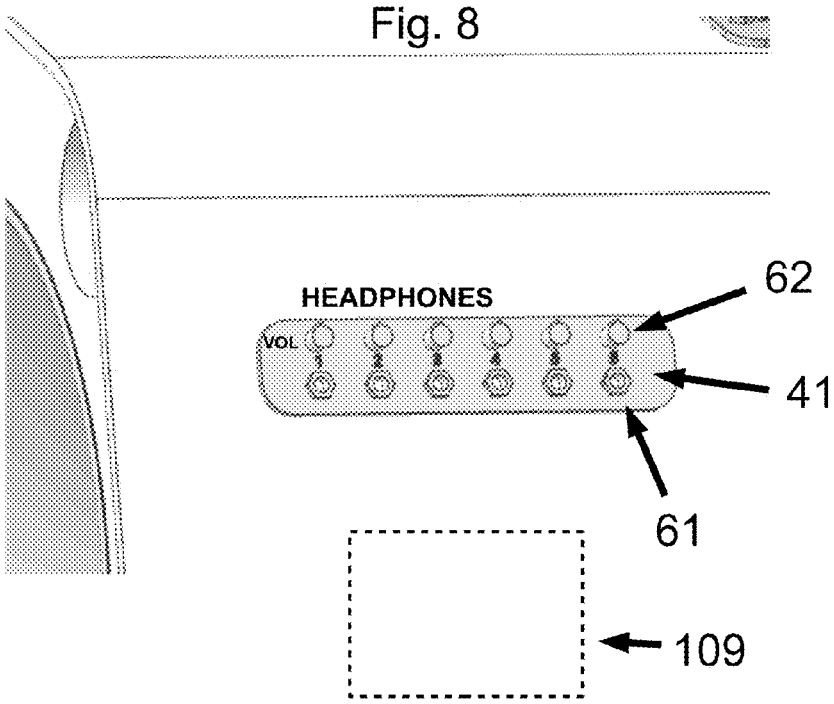
FIG. 8 shows the headphone jack panel as viewed from the left side of the invention.

FIG. 8 shows the left side of the invention where the headphones panel 41 could be located. There is depicted a row of headphone jacks 61 with each jack having its respective volume control 62. The number of jacks and volume controls may vary. There is an internal headphone mixer 109 which allows several musicians to listen to any or all of the inputs to the instrument, which may include a drum module, the MP3 player, and every musician or singer who is plugged into the previously discussed input panel in FIG. 7. The purpose for this arrangement is to allow an entire band to rehearse together in situations where noise output from instruments or amplifiers is not allowed, wherein every player can hear all other players simultaneously, while also listening to an MP3 player song if desired.

Figure 9:
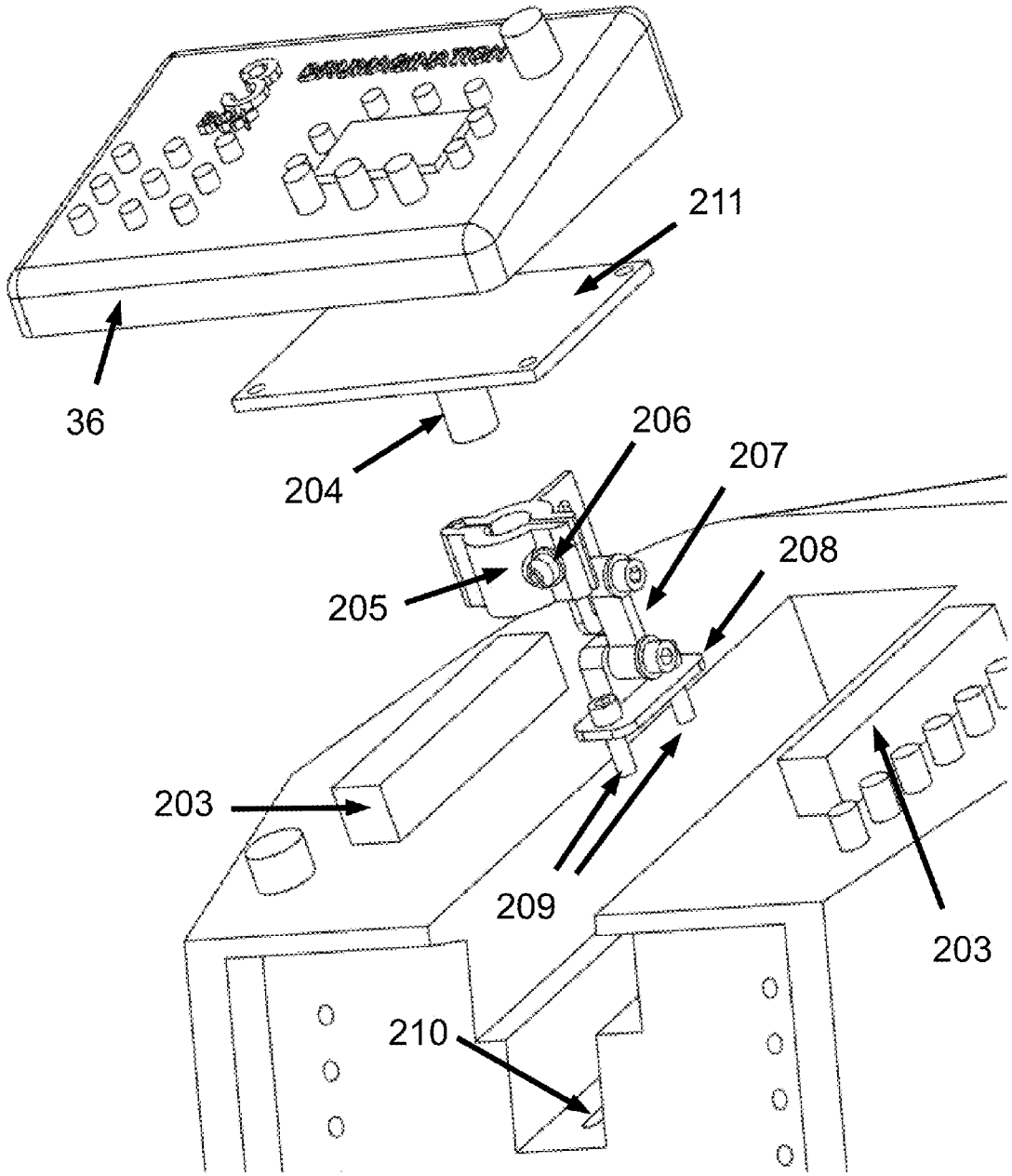
FIG. 9 shows a right rear exploded view of a shock absorbing mount system.

The drum module can be bolted directly to the outside of the shell. However, this may subject the drum module to unwanted vibrations. FIG. 9 shows an exploded view of one embodiment of my shock dampening removable drum module mounting apparatus.

Virtually all commercial drum modules are attached to rack clamps using either built-in mounting pipes or universal bolt-on brackets 211 that have a mounting pipe 204 attached. In my invention, the pipe 204 fits into the mounting clamp assembly 205 and is secured using a tightening screw 206. A dog-bone linkage device 207 is pivotally attached on one end to the mounting clamp assembly 205 and is pivotally attached to the clamp base 208 on the other end. The dog-bone linkage device may be made of rubber or a solid material. The clamp base assembly 208 is bolted into the drum shell adjustment track 210 using attachment bolts 209. Note that the adjustment track 210 is long enough to accept any drum module regardless of size. This mounting device holds the module loosely in place, and most of the weight is supported by the shock absorbing pads 203. These pads 203 can be made out of foam, foam rubber, springs, or other shock absorptive materials.

FIGS. 10A, 10*b* and 10*c* show a similar embodiment with a rigid linkage device 216 that connects the clamp base assembly 208 and the mounting clamp assembly 205. The height of the entire bracket is adjustable using adjustment bolts 212 that bolt into a track 214 on the clamp assembly. In this embodiment, the lower attachment bolt 213 is a pivot point, allowing the rigid linkage to pivot, thereby preventing impact vibrations from the drum pedal or loudspeakers from being transferred directly to the electronic drum module. Again, the weight of the unit is primarily supported by the shock absorbing pads, depicted in FIG. 10C as corner foam units 217 attached to the shell with adhesive.

An auxiliary jack panel 292 is shown in FIG. 11, and a corresponding schematic is presented in FIG. 11*a*. Some drummers may want more electronic drum instruments than one module can accommodate. An auxiliary module input jack 218 allows a secondary module to be mixed with the mounted drum module 36 and routed to the amplifier.

Figure 1:
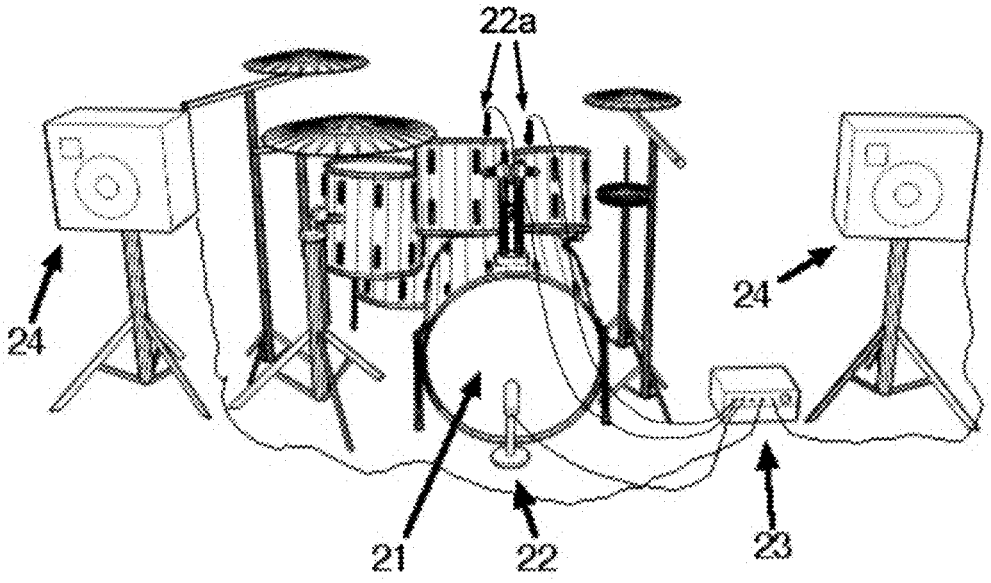
FIG. 1 Prior Art
Figure 1A:
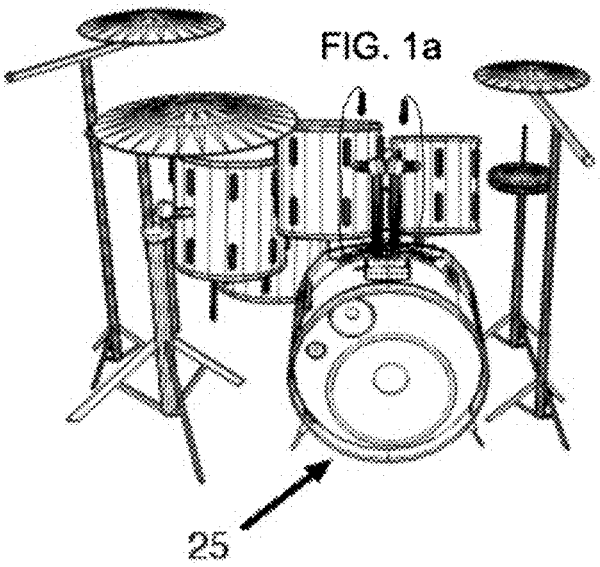
Figure 2:
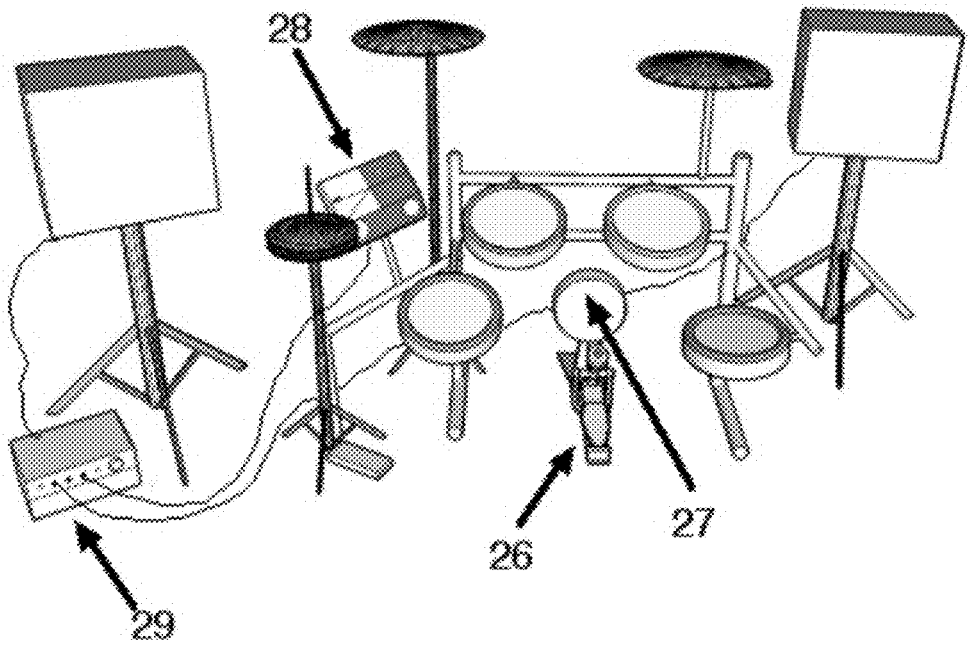
FIG. 2 Prior Art
Figure 2A:
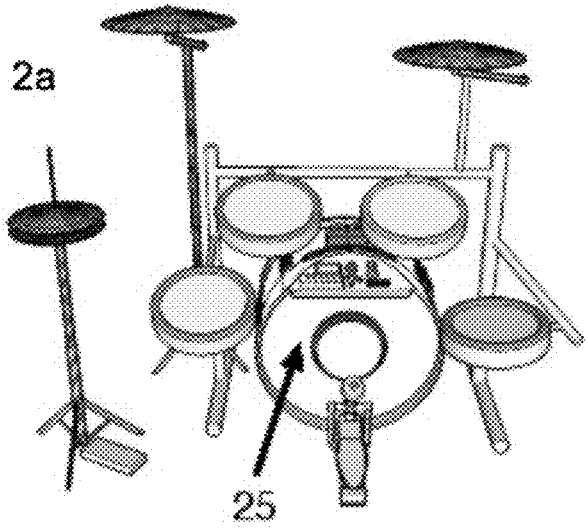
Figure 2B:
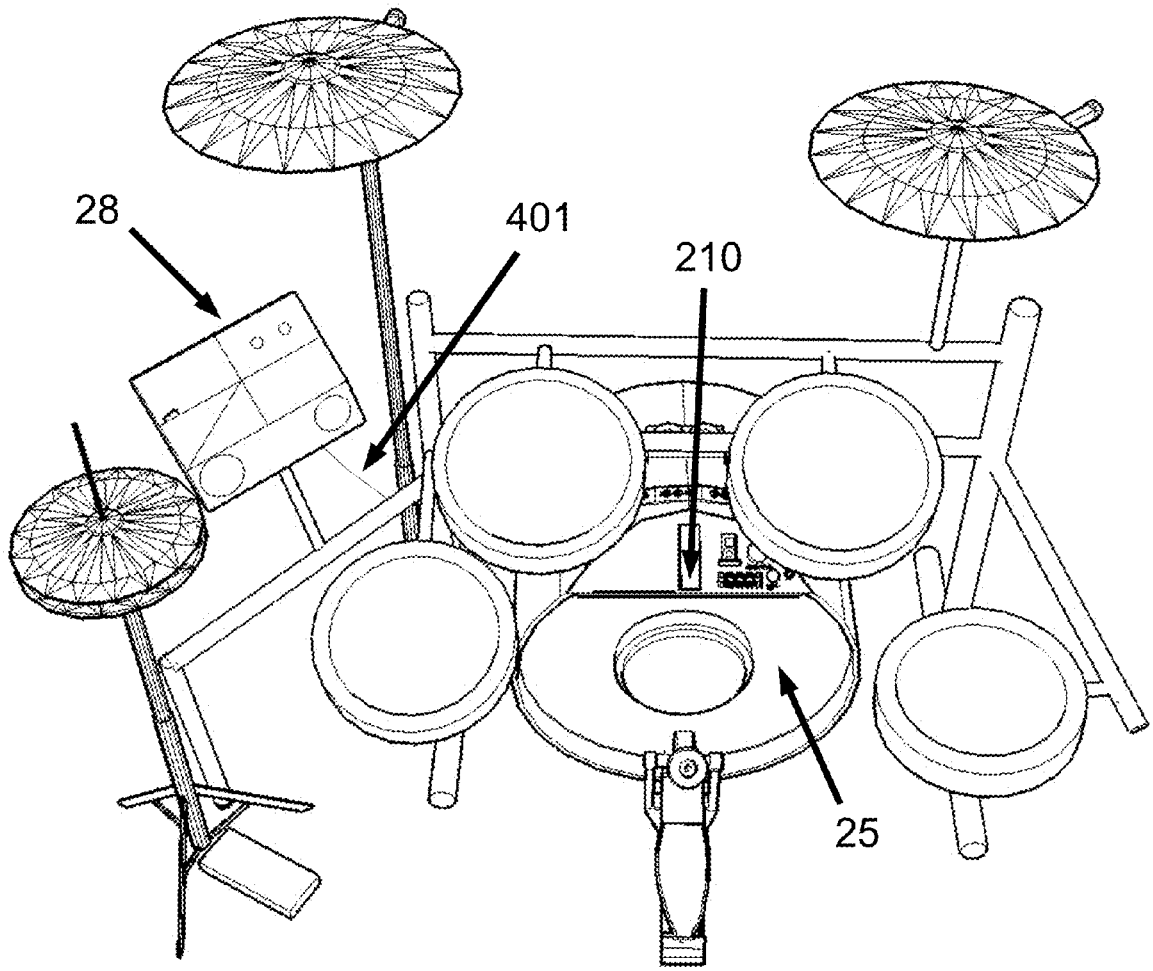

There are drummers that will want to keep their drum modules in the original location that was designed into their existing electronic drum kits. FIG. 2*b* shows such a conventional kit which has a drum module 28 mounted on the left side of the kit. Note that the drum shell track 210 has all module mounting devices removed. An electrical cable 401 allows the output of the drum module 28 to connect to the internal mixer and amplifier through the input jack 218 of FIG. 11.

The stereo mixer output jack 219 is used for connecting an external amplifier in situations where the internal amplifier and speakers of the invention are not powerful enough to be heard by an entire audience, at a stadium concert for example. This signal could then conceivably be routed to a huge external amplifier, and a massive wall of speakers could fill the stadium with sound.

For most applications, a single channel is used to drive the internal speakers in my invention. However, most drum modules and amplifiers have stereo outputs. The auxiliary speaker output jack 220 is used to power a second speaker channel using the internal amplifier.

The speaker input jack 221 takes an amplifier signal from an external amplifier and routes it directly to the internal speakers at the front of my invention. This would come in handy in the event of an internal amplifier failure.

Note that in FIG. 11, two electronic drum kick pads 222, 223 are depicted. This allows drummers who use double pedals to have different sounds triggered by the two pads.

In some instances, connecting electronic drum instruments directly to the back of the shock-mounted drum module would put wires in the drummers way or be unsightly. My invention includes internal extension cables depicted in FIG. 12. An instrument can be plugged into a jack 224 mounted on the outside of the shell 227, and the extension wire 225 runs inside of the shell and ends at a plug 226 near the back of the module mount.

Lots of electrical wiring clutter can be hidden inside the shell of the drum as well. In FIG. 12, an electrical power cord 260 runs inside of the drum and is split to power the internal amp and the internally mounted drum module power supply brick 262. A low voltage output is then delivered to the module power plug 264 using an internal power supply line 263.

In order to protect the loudspeakers at the front of the instrument from dust, debris or physical damage, a cover 230 is depicted in FIG. 13. This cover could be made out of speaker cloth or other loosely woven material, to allow the sound produced by the speakers to fully project to the audience. Note that a band name or other logo 231 could be written on the cover.

An easy transport system has been incorporated into my invention. In FIG. 14*a*, the drum is set up to perform, and the extendable legs 31 lift the transport wheels 200 off of the ground. When the legs 31 are retracted as in FIG. 14*b*, the front of the instrument rests on the transport wheels. A handle 232 is attached and the drum is ready to roll.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

The invention claimed is:

1. An electronic bass drum assembly comprising:

an outer shell having a front planar wall and a side wall, said outer shell defining an interior cavity;

at least one loudspeaker disposed within said interior cavity;

an internal amplifier disposed within said interior cavity, said internal amplifier electrically coupled to and powering said at least one loudspeaker;

at least one input jack electrically coupled to said internal amplifier and disposed on said outer shell, wherein an external electronic device is connectable to said at least one input jack and thereby in communication with said internal amplifier;

a removable drum module mounting apparatus including means for coupling a removable drum module to said electronic bass drum assembly so that said removable drum module is in communication with said internal amplifier; and at least one impact sensitive electronic drum kick pad.

2. The electronic bass drum assembly of claim 1, wherein said drum module mounting apparatus is a shock dampening drum module mounting apparatus comprising a shock absorptive material.

3. The electronic bass drum assembly of claim 2, wherein said shock dampening drum module mounting apparatus comprises a mounting clamp assembly configured for attaching ft said removable drum module thereto.

4. The electronic bass drum assembly of claim 2, wherein said shock dampening drum module mounting apparatus comprises a clamp base assembly securable to an adjustment track disposed on said outer shell.

5. The electronic bass drum assembly of claim 4, wherein said shock dampening drum module mounting apparatus comprises a linkage device connecting said clamp base assembly to said removable drum module, said linkage device having at least one pivot point.

6. The electronic bass drum assembly of claim 1, wherein said at least one input jack is a first input jack, further comprising at least a second input jack electrically coupled to at least one of: said internal amplifier; an internal mixer; said drum module; or a headphone mixing panel.

7. The electronic bass drum assembly of claim 6, wherein said external electronic device connectable to said first input jack is a first external electronic device, and wherein a second external electronic device is connectable to said second input jack.

8. The electronic bass drum assembly of claim 6, further comprising a plurality of volume controls disposed on said outer shell, each one of said volume controls operably associated with a corresponding one of said input jacks.

9. The electronic bass drum assembly of claim 6, further comprising a plurality of volume controls disposed on said outer shell, said plurality of volume controls operably associated with one or more of said internal amplifier, said internal mixer, said drum module, or said headphone mixing panel.

10. The electronic bass drum assembly of claim 1, further comprising a control panel operably disposed on said outer shell, said control panel comprising said at least one input jack and a plurality of auxiliary controls in communication with said internal amplifier for sending signals thereto.

11. The electronic bass drum assembly of claim 10, wherein said control panel comprises a control for controlling volume of said internal amplifier.

12. The electronic bass drum assembly of claim 10, wherein said control panel comprises at least one equalizer control.

13. The electronic bass drum assembly of claim 1, further comprising said drum module removably coupled to said drum module mounting apparatus.

14. The electronic bass drum assembly of claim 13, wherein said removable drum module comprises one or more jacks configured to send and receive MIDI signals.

15. The electronic bass drum assembly of claim 13, further comprising a removable cowling securable to said outer shell and configured to receive said drum module.

16. The electronic bass drum assembly of claim 13, wherein said drum module is in communication with said internal amplifier via said at least one input jack.

17. The electronic bass drum assembly of claim 13, further comprising a bass drum pedal operably associated with said at least one impact sensitive electronic drum kick pad, said at least one impact sensitive electronic drum kick pad in communication with said drum module.

18. The electronic bass drum assembly of claim 1, wherein said at least one impact sensitive electronic drum kick pad is coupled to a rear wall of said outer shell via a vibration dampening bracket.

19. The electronic bass drum assembly of claim 1, further comprising an MP3 player dock configured to receive a removable MP3 player so that the removable MP3 player is in communication with at least one of: said internal amplifier; an internal mixer; or said external electronic device.

20. The electronic bass drum assembly of claim 1, further comprising a headphone mixing panel including an internal headphone mixer configured to permit monitoring of operably connected external electronic devices, said headphone mixing panel having at least one headphone jack and at least one corresponding volume control.

21. The electronic bass drum assembly of claim 1, further comprising an internal cooling fan disposed within said internal cavity.

22. The electronic bass drum assembly of claim 1, further comprising mounting hardware configured for mounting percussion instruments to said outer shell.

23. The electronic bass drum assembly of claim 1, further comprising a cover removably mountable over at least a portion of said front planar wall.

24. The electronic bass drum assembly of claim 1, further comprising external wheels and a handle coupled to said outer shell.

25. The electronic bass drum assembly of claim 1, further comprising an internal mixer disposed within said internal cavity, and a mixer output jack operably disposed on said outer shell and electronically coupled to said internal mixer, wherein an output signal from said internal mixer is routable to an external amplifier through said mixer output jack.

26. The electronic bass drum assembly of claim 1, further comprising an auxiliary speaker output jack operably disposed on said outer shell and electronically coupled to said internal amplifier, wherein an output signal from said internal amplifier is routable to one or more external loudspeakers through said auxiliary speaker output jack.

27. The electronic bass drum assembly of claim 1, further comprising a speaker input jack operably disposed on said outer shell and electronically coupled to said at least one loudspeaker, wherein a signal from an external amplifier is routable to said at least one loudspeaker through said speaker input jack.

28. The electronic bass drum assembly of claim 1, wherein said external electronic device is selected from the group consisting of a drum module, an external loudspeaker, an external amplifier, an external electronic instrument, and a microphone.

29. An electronic bass drum assembly comprising:

an outer shell having a front planar wall and a side wall, said outer shell defining an interior cavity;

at least one loudspeaker disposed within said interior cavity;

an internal amplifier disposed within said interior cavity, said internal amplifier electrically coupled to and powering said at least one loudspeaker;

at least one input jack electrically coupled to said internal amplifier and disposed on said outer shell, wherein an external electronic device is connectable to said at least one input jack and thereby in communication with said internal amplifier;

a removable drum module mounting apparatus comprising a clamp assembly configured for attaching a removable drum module, a base assembly securable to said outer shell, and a linkage device having a first end connected to said clamp assembly and a second end connected to said base assembly; and at least one impact sensitive electronic drum kick pad.

30. The electronic bass drum assembly of claim 29, wherein said at least one input jack is a first input jack, further comprising at least a second input jack electrically coupled to said internal amplifier, an internal mixer, said removable drum module, or a headphone mixing panel.

31. The electronic bass drum assembly of claim 30, wherein said external electronic device connectable to said first input jack is a first external electronic device, and wherein a second external electronic device is connectable to said second input jack.

* * * * *